United States Patent [19]

Poe

[11] 4,220,364

[45] Sep. 2, 1980

[54] FLUSH TYPE LATCHES

[75] Inventor: L. Richard Poe, Long Beach, Calif.

[73] Assignee: Hartwell Corporation, Placentia, Calif.

[21] Appl. No.: 882,174

[22] Filed: Mar. 1, 1978

[51] Int. Cl.[2] ..... E05B 15/02

[52] U.S. Cl. ..... 292/341.18; 292/113

[58] Field of Search ..... 292/341.18, 113, 158, 292/139, 341.19, 340, DIG. 31

[56] References Cited

U.S. PATENT DOCUMENTS

| | | | |
|---|---|---|---|
| 1,119,321 | 12/1914 | Schmidgall | 292/341.18 |
| 1,250,574 | 12/1917 | Ferris | 292/113 |
| 2,089,163 | 8/1937 | Hansen | 292/341.18 |
| 2,710,214 | 6/1955 | Summers | 292/113 X |
| 2,712,955 | 7/1955 | Andrews | 292/DIG. 31 |
| 3,664,696 | 5/1972 | Poe | 292/DIG. 31 |

FOREIGN PATENT DOCUMENTS

| | | | |
|---|---|---|---|
| 543914 | 9/1922 | France | 292/341.18 |

*Primary Examiner*—J. Franklin Foss
*Attorney, Agent, or Firm*—Lyon & Lyon

[57] ABSTRACT

A tension adjuster for flush type latches, such as is used by aircraft, of the type wherein a handle is received in an opening and is pivotable between a flush position and an initial open position while the latch arm remains in hooked engagement with a keeper, the tension adjuster utilizing a screwthreaded member to effect longitudinal adjustment of the keeper and being accessible to a turning tool insertable into the end of the opening when the handle is in its initial open position.

2 Claims, 4 Drawing Figures

FLUSH TYPE LATCHES

BACKGROUND

Aircraft are provided with a substantial number of outwardly exposed flush panels which are removable or hinged to the surrounding surface of the aircraft, such panels having one or more flush mounted latch assemblies. Due to the high forces exerted on the surface of the aircraft, proper adjustment between a hook latch arm of a latch assembly and a corresponding keeper arm secured to an adjacent portion of the aircraft structure is of primary importance. Adjustment requires access to the keeper; usually this has required complete disengagement of the hook arm and keeper.

SUMMARY

The present invention is directed to a tension adjuster for flush type latches which provides access while the hook arm and keeper element are in mutual engagement to facilitate dependable and predictable loading of the flush type latches to insure dependibility under extreme conditions of use, and is summarized in the following objects:

First, to provide a tension adjuster for flush type latches wherein a novelly arranged keeper is longitudinally movable by means of a novelly arranged screw shaft disposed inwardly of but adjacent the surface of the aircraft and is positioned for access by a turning tool readily accessible when the flush latch is in its initial open position.

Second, to provide a tension adjuster which may be substituted for conventional adjusters without replacement of the flush type latch.

DETAILED DESCRIPTION

Figure 1:
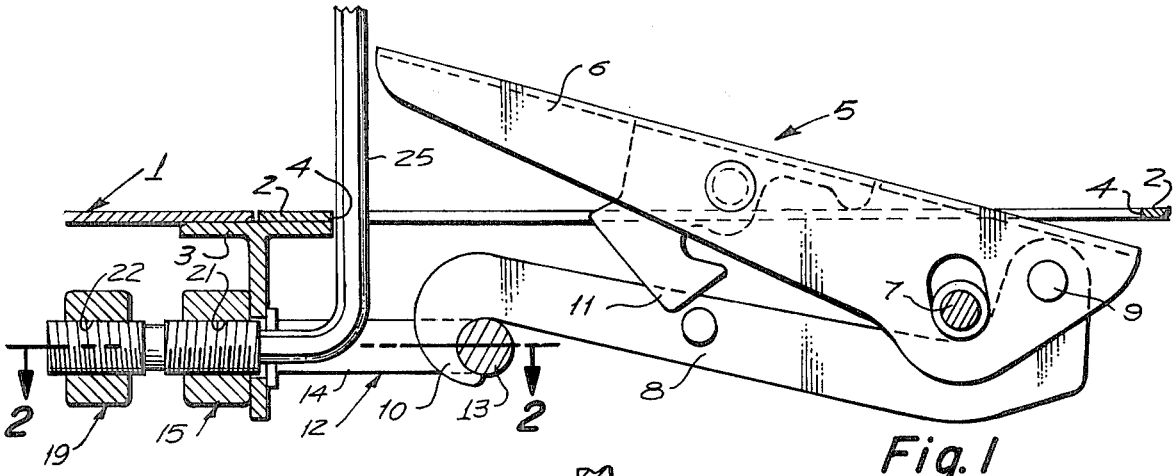
FIG. 1 is a fragmentary sectional view of a panel and frame fitted with a flush type latch assembly and showing in section the tension adjuster for the latch.
Figure 2:
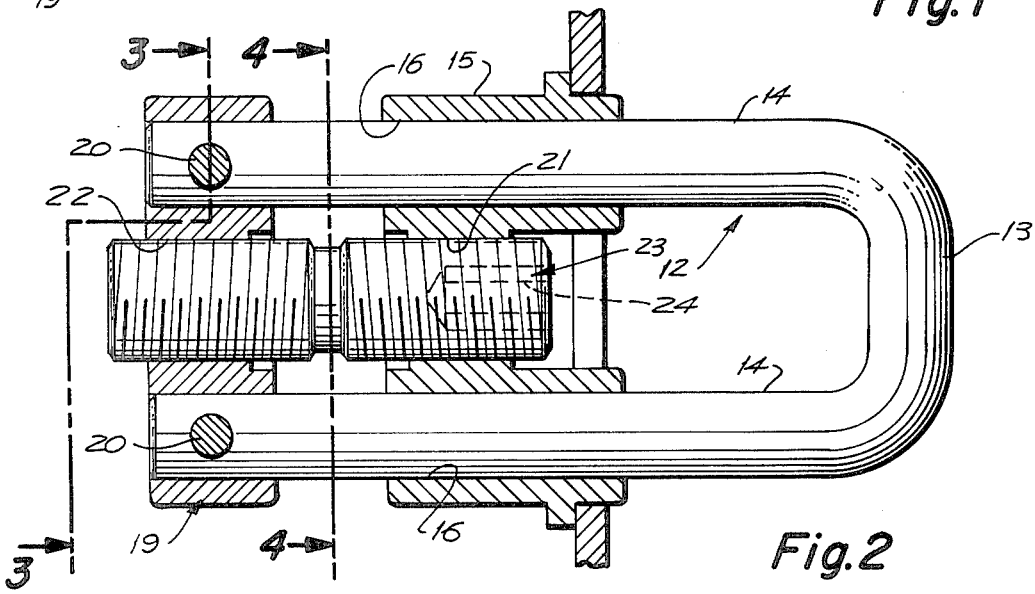
FIG. 2 is an enlarged sectional view of the tension adjuster taken through 2—2 of FIG. 1.
Figure 3:
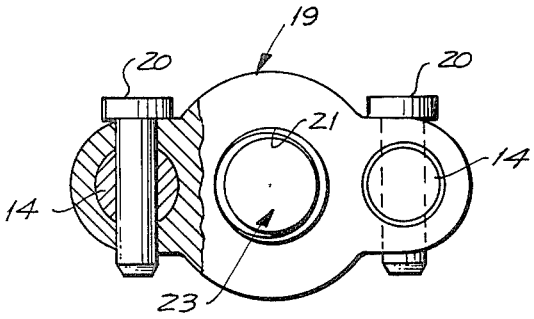
FIG. 3 is a partial sectional, partial end view taken through 3—3 of FIG. 2 and turned 90°.
Figure 4:
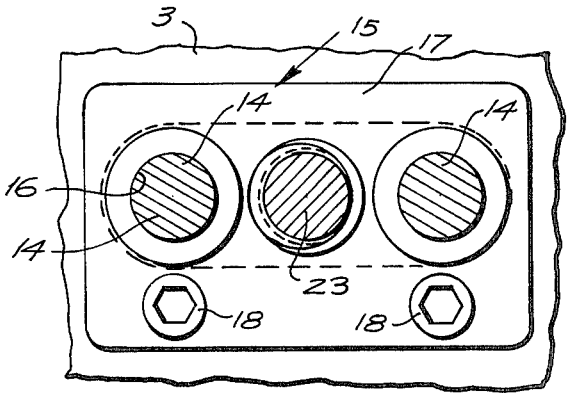
FIG. 4 is a transverse sectional view taken through 4—4 of FIG. 2, also turned 90°.

The tension adjuster for flush type latches is intended primarily for aircraft represented fragmentarily by skin structure designated 1. Disposed flush with the skin structure is a panel 2 supported by a frame 3. The panel 2 is provided with a rectangular opening 4, dimensioned to receive a flush type latch assembly 5.

The latch assembly 5 may be considered as conventional and includes a handle lever 6 having a pivot pin 7 near one end which permits movement of the handle lever between a flush position and initial angular position and a full open position, the handle being illustrated in its initial angular position. The handle lever 6 is channel shaped in cross section and receives a latch arm 8 connected to the handle lever 6 by a pivot pin 9. The extended ends of the handle lever and latch arm are disposed at one end of the rectangular opening 4 and the extremity of the latch arm 8 is provided with a hook 10. When the handle lever 6 is in its flush position, it is joined to the latch arm 8 by a linking latch 11 capable of manual movement so that the handle lever may be moved to the initial angular position shown and a full angular position not shown.

The structure thus far described may be considered as conventional and may be considered as a modification of the structure shown in U.S. Pat. Nos. 2,712,955 or 3,542,410.

The hook extremity 10 is positioned adjacent one side of the frame 3 and receives a U-shaped keeper 12 comprising a cross portion 13 and parallel portions 14. Secured to the adjacent portion of the frame 3 is a guide block 15 having parallel bores 16 which slidably receive the parallel portions 14 of the keeper 12. The guide block 15 includes a mounting plate 17 which is secured to the frame 3 by screws 18.

The extended ends of the parallel portions 14 are joined by a cross bar 19 which is secured thereto by anchor pins 20. Centered with respect to the parallel portions 14 of the keeper is a screwthreaded bore 21. The cross bar 19 is provided with a second screwthreaded bore 22 disposed in coaxial relation to the bore 21. The screwthreaded bores are of opposite pitch and receive a drive shaft 23 having external screwthreads of opposite pitch. One end of the drive shaft 23 is in close relation to the corresponding end of the rectangular opening 4. Also the entire keeper structure is in close proximity to the surface of the panel 2. The drive shaft 23 is provided with a drive socket 24 of polygonal cross section. The drive socket is so positioned that a polygonally shaped rod wrench 25 may be inserted through the opening 4 when the handle lever is in its initial angular position and manipulated into engagement with the drive socket 24. Such wrench is known commercially as an Allen wrench.

Operation of the tension adjuster for flush type latches is as follows:

Initially the handle lever 6 is raised from its flush position to the initial angular position shown in FIG. 1. This provides access to the drive shaft 23 by means of the Allen wrench 25. In this position of the latch assembly, the latch arm 8 and keeper 12 remain in mutual engagement. The drive shaft 23 is then turned causing the keeper 12 to extend or retract. After a tentative adjustment is made, the Allen wrench is removed and the handle lever closed to test the adjustment. It will be noted that while some manipulation of the latch is required in the course of adjustment, the amount of movement is minimal and quickly accomplished.

Having fully described my invention, it is to be understood that I am not to be limited to the details herein set forth, but that my invention is of the full scope of the appended claims.

I claim:

1. A tension adjuster for a latch having a handle movable between a position flush with a surrounding panel set in a surface structure and an angular position diverging from said panel wherein the extended end of the handle and corresponding portion of said panel forms an aperture exposing a limited area underlying the panel and exposing a panel frame, the latch also having a hook arm extending into said limited area, the tension adjuster comprising:

a. a keeper engaging the hook arm and continuing therefrom;

b. a mounting body secured to the panel frame and slidably receiving the keeper;

c. a drive bar having a first connection with the housing and a second connection wsith the keeper wherein both connections between the drive bar, keeper and housing are screwthreaded and of opposite pitch whereby rotation in one direction increases tension on the hook arm, while rotation in the opposite direction reduces tension on the hook arm, the screwthreaded connections being of equal pitch whereby the drive bar remains essentially in a fixed position one of the connections being screwthreaded to effect reciprocal movement of the keeper upon rotation of the drive bar; and d. the drive bar having a turning socket extending into one end for receiving a turning tool inserted through said aperture.

2. A tension adjuster for a latch having a handle movable between a position flush with a surrounding panel set in a surface structure and an angular position diverging from said panel wherein the extended end of the handle and corresponding portion of said panel forms an aperture exposing a limited area underlying the panel and exposing a panel frame, the latch also having a hook arm extending into said limited area, the tension adjuster comprising:

a. a keeper engaging the hook arm and continuing therefrom, the keeper being provided with a pair of parallel keeper shafts;

b. a cross bar extending between and secured to the keeper shafts;

c. a mounting body secured to the panel frame and slidably receiving the keeper the mounting body having a pair of bores receiving the keeper shafts;

d. the mounting body and cross bar have coaxial screwthreaded bores of opposite pitch;

e. a drive bar having a first connection with the housing and a second connection with the keeper and the drive bar having coaxial externally screwthreaded portions also of opposite pitch received in the screwthreaded bores, to effect longitudinal movement of the keeper shafts while maintaining the axis of the drive bar in an essentially fixed position;

f. the drive bar having a turning socket extending into one end for receiving a turning tool inserted through said aperture.

* * * * *